United States Patent [19]

Herburg

[11] 4,195,509

[45] Apr. 1, 1980

[54] DEVICE FOR BENDING RING SEGMENT-SHAPED PLATE BLANKS INTO CONICALLY SHAPED PARTS

[75] Inventor: Rudolf Herburg, Hamburg, Fed. Rep. of Germany

[73] Assignee: Hinrichs Gesellschaft mit beschränkter Haftung, Geesthaght, Fed. Rep. of Germany

[21] Appl. No.: 934,724

[22] Filed: Aug. 21, 1978

Related U.S. Application Data

[63] Continuation of Ser. No. 801,339, May 27, 1977, abandoned.

[30] Foreign Application Priority Data

Jun. 12, 1976 [DE] Fed. Rep. of Germany ..... 2626452

[51] Int. Cl.[2] ..... B21D 11/08; B21D 5/14

[52] U.S. Cl. ..... 72/167; 72/171

[58] Field of Search ..... 72/167, 169, 171, 172

[56] References Cited

U.S. PATENT DOCUMENTS

| | | | |
|---|---|---|---|
| 2,806,096 | 10/1957 | Erkes | 72/171 X |
| 3,287,953 | 11/1966 | Boldrini | 72/171 |

*Primary Examiner*—Milton S. Mehr

*Attorney, Agent, or Firm*—Toren, McGeady and Stanger

[57] ABSTRACT

A device for bending ring segment-shaped plate blanks into conically shaped parts includes a pair of roll stands, a top roller, or a centrally positioned pair of top rollers supported between the roll stands, and a pair of side rollers positioned on either side of the top roller and also supported between the roll stands. Means are provided for driving the blanks between the top roller and the side rollers to form the conically shaped parts. At least one abutment member is carried by the device for engaging and guiding the short arc edge of the plate blanks. An elastic and adjustable counter pressure mechanism is connected to the abutment member so that at least a component of the bearing pressure on the abutment member is transmitted to the counter pressure mechanism for controlling the means for driving the plate through the rollers to form the conically shaped parts.

22 Claims, 6 Drawing Figures

DEVICE FOR BENDING RING SEGMENT-SHAPED PLATE BLANKS INTO CONICALLY SHAPED PARTS

This is a continuation of application Ser. No. 801,339 filed on May 27, 1977, now abandoned.

BACKGROUND OF THE INVENTION

The present invention relates generally to bending machines and more particularly to a device for bending ring segment-shaped plate blanks into conically shaped parts.

Typically known plate bending machines generally include a pair of supporting roll stands with a top roller, or a central pair of top rollers, supported between the roll stands with two side rollers also supported between the pair of roll stands and positioned on either side of the top roller or the central pair of rollers. Additionally, known bending machines for forming conically shaped parts also include one or two abutment members positioned for engaging and guiding the shorter arc edge of the plate blank to be formed into the conical part. Plate bending machines used for this purpose can be of any known type such as the three roller type using a top roller and two side rollers, or the four roller type using the central pair of rollers with the two side rollers. Additionally, means are provided for rotatably driving at least one of the rollers so that the plate blanks can be fed in a direction between the top roller or the central pair of rollers and the two side rollers so as to form the conical part. The present invention can be applied to either the three or four roller type of bending machine and it is irrelevant which of the rollers are rotatably driven, or adjustable in any particular direction or tiltable and movable to effect the conical bending operation.

The formation of conically shaped parts on plate bending machines of the foregoing type is inherently problematic because the feeding movement of the driving rollers at any particular point on the plate blank extends in a direction perpendicular to the longitudinal axis of the rollers, while the bending lines of the conically shaped parts extend radially from the center of the ring segment to the intersection of the generatrices of the cone. As a result, the larger outer radius of the plate blank must be accelerated with respect to the velocity of the feeding rollers while the smaller inner radius of the blank must be decelerated.

Known devices for forming conically shaped parts and which effect a corresponding forced guidance of the plate blank during the bending operation include a three roller plate bending machine having two thrust rollers or bolts which are supported on the roll stands of the machine or on bearings for adjustable rollers (see German DAS No. 1,269,084), or include a four roller plate bending machine having a guide shoe which is centrally arranged between the bearing pins of the bending rollers, i.e. on the bearing of the bottom roller (see German Pat. No. DES 6,913,573).

Also known, is the use of a butting plate used as an abutment member in a three roller plate bending machine. The butting plate is arranged on the inside of the roll stands and can be lowered to remove the finished work piece from the working zone of the machine.

The foregoing known devices, however, suffer from a number of disadvantages. When forming the conically shaped parts, the plate edge on the inner radius of the plate blank produces a high bearing pressure against the abutment on which it bears, the extent of which is dependent upon frictional forces existing between the plate blank and the bending rollers. When the plates exert an excessive pressure against the abutments, the abutments may be destroyed or damaged, or the edges of the plate will become damaged or misaligned. Because the frictional forces between the plate and the bending rollers depend upon the thickness of the plate, the width of the plate, the particular material of the plate and of the bending rollers, and the desired dimensions of the cone parts to be formed, such overloading or exertion of excessive bearing pressure frequently occurs.

Additionally, the horizontal forces extending in the longitudinal direction of the bending rollers which act both on the abutment and on the bearings for the bendingrollers can tend to force the machine roll stands apart. This can only be prevented by the use of additional and elaborate reinforcement members for the frame and the roll stands of the machine.

Further, the range of cone designs which can be produced on known plate bending machines is very limited because the abutment members are typically arranged in a fixed or stationary position located on one side of the machine at the ends of the bending rollers. Consequently, only those plates which do not bear on the roll stand or on the bearing for the top roller during the bending operation can be bent into the desired shape. This is particularly true in large bending machines.

It is accordingly the principal object of the present invention to provide a device for bending plate blanks into conically shaped parts which avoids the foregoing disadvantages of known devices and to also permit the utilization of screw-down forces of the screw-down drives of a bending roller by working centrally in order to increase the plate thickness with a reduced plate width.

It is another and more specific object of the present invention to provide a device for bending plate blanks into conically shaped parts having one or more abutment members which transmit bearing pressure or at least a component thereof to a counter pressure mechanism which cooperates with a switch device for controlling the means for rotatably driving the bending rollers.

Yet a further object of the present invention is to provide a bending device of the foregoing type which permits excessive bearing pressures on the abutment which will exceed a predetermined value without causing the roll stands to be forced apart by utilizing means to allow the abutments to yield to such excessive pressure and resulting in automatically turning off the drive for the machine to thus avoid overloading conditions.

Other features, objects and advantages of the present invention will become more apparent from the detailed description of the invention in connection with the accompanying drawings to be described more fully hereinafter.

SUMMARY OF THE INVENTION

The foregoing objects are generally accomplished by providing a device for bending ring segment-shaped plate blanks into conically shaped parts, which device includes a pair of roll stands, at least one top roller or a central pair of rollers supported between the roll stands, a pair of side rollers positioned on either side of the top roller or central pair of rollers and also supported between the roll stands, and means for driving at least one of the rollers to drive the blanks between the top roller or central pair of rollers and the side rollers to form the conically shaped parts. The device is provided with at least one abutment member positioned for engaging and guiding the short arc edge of the plate blanks. The specific improvement of the invention is provided by the inclusion of an elastic and adjustable counter pressure mechanism connected to the abutment member so that at least a component of the bearing pressure on the abutment member will be transmitted to the counter pressure mechanism so that the counter pressure mechanism can control the driving means. The counter pressure mechanism is adjustable in order to correspond to the permissible pressure load on the abutment. As a result, if the permissible pressure load on the abutment is exceeded the abutment will be able to yield so that the cooperation between the counter pressure mechanism and the drive means will result in turning off the drive so as to avoid overloading conditions.

The counter pressure mechanism can be designed as a pressure cylinder, hydraulic cylinder, spring, or any other system which can operate in a similar manner.

The abutment members can be mounted on a traverse member supported between the roll stands or on a swing lever pivotally connected at one end thereof to the roll stand positioned at that end of the machine opposite the direction of thrust. Therefore, the oppositely directed horizontal forces will act only on one of the roll stands of the machine.

When a pressure cylinder is used as the counter pressure mechanism, it is possible to adjust the optimum operating position of the abutment member through the counter pressure mechanism by appropriately dimensioning the stroke and corresponding elements of the counter pressure mechanism.

Additionally, the counter pressure mechanism is designed and arranged for mounting on the machine in such a manner as to permit the abutment member to perform two functions so that it does not have to be removed for removal of the finished bent conically shaped part. One such function is to permit yielding at overload conditions, and the other is to permit lowering from the working zone of the machine. This can be accomplished by the use of a separate arrangement for the counter pressure mechanism and for a retracting mechanism. It can also be accomplished by replacing the retracting mechanism with a swing-away mechanism specially designed for the plate bending machine.

Further, the abutment member can be mounted on either a traverse member or a swing lever for displacement in a direction generally parallel to the axis of the bending rollers so that it may be moved into any desired position within the working zone of the bending rollers. In this manner the range of conical designs and dimensions which can be produced by the particular machine is substantially increased, particularly when using large machines. Since this will also permit forming the conical parts at the center of the bending rollers, a maximum plate thickness can be deformed because the screw-down forces of both screw-down drives for the bending rollers can be fully utilized.

This results in a considerable increase in production capabilities of a plate bending machine provided with the device of the present invention. Significant advantages in production of conically shaped parts from plate blanks can therefore be achieved by using the principles in accordance with the present invention and providing for an abutment which is displaceably mounted in a longitudinal direction so that the position of the working zone can be determined by the position of the abutment. Means can also be provided to lock the abutment in the desired position once it has been moved in the longitudinal direction.

BRIEF DESCRIPTION OF THE DRAWINGS

There follows a detailed description of the invention in connection with the following accompanying drawings in which.

DESCRIPTION OF THE INVENTION

Referring now in more detail to the accompanying drawings a plate bending machine is shown which includes a pair of roll stands 1 and 2 for supporting therebetween the bending rollers. Depending upon the design of the machine there may be either three such bending rollers or four such bending rollers. A top roller 3 can be supplemented by a bottom roller 3*a* (see FIG. 4) and a pair of side rollers 4 positioned on both sides of the top roller 3 or of the combination of the top roller 3 and bottom roller 3*a*.

In order to provide for movement of the plate blanks between the rollers to form the conically shaped parts, the bending rollers may be vertically, horizontally or obliquely adjustable or may be mounted in a fixed stationary position and provided with a rotary drive 20 for moving the plates. In addition, the movable bending rollers may be inclined so as to form the conically shaped parts from ring segment-shaped plate blanks.

A movable bearing 1*a* of top roller 3 is provided to permit removal of a finished bent cone from the machine by appropriate swinging movement of the bearing 1*a*.

Figure 6:
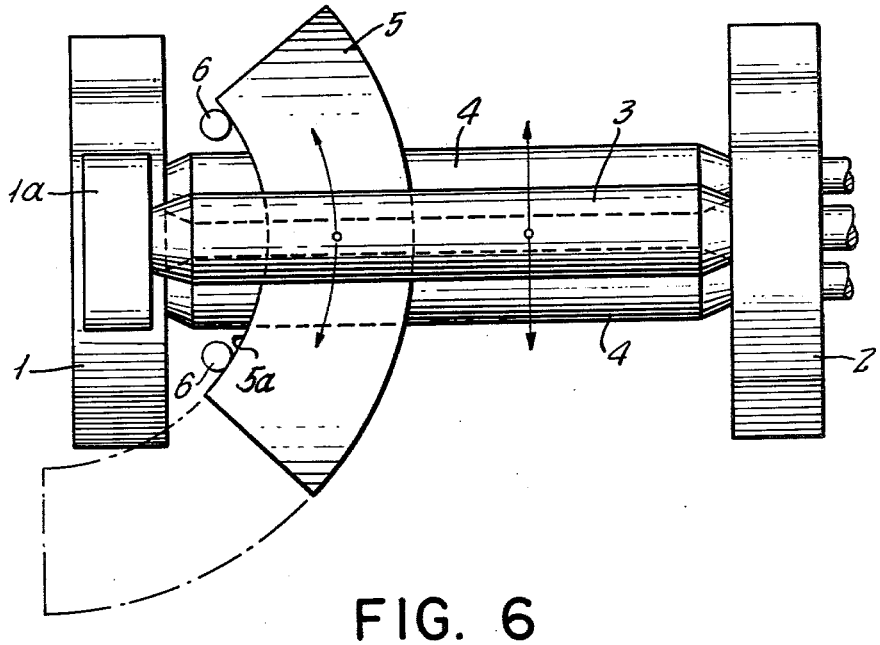
FIG. 6 is a top plan view similar to that of FIG. 5 showing a plate bending machine having two abutment members.

At least one abutment member 6 is provided for the forced guidance of the plate blank 5 as a result of the smaller inner radius 5*a* of the plate blank 5 bearing against the abutment member. Two such abutment members, such as shown in FIG. 6, may also be provided. The abutment members 6 can be arranged either between or next to the side rollers 4.

Figure 1:
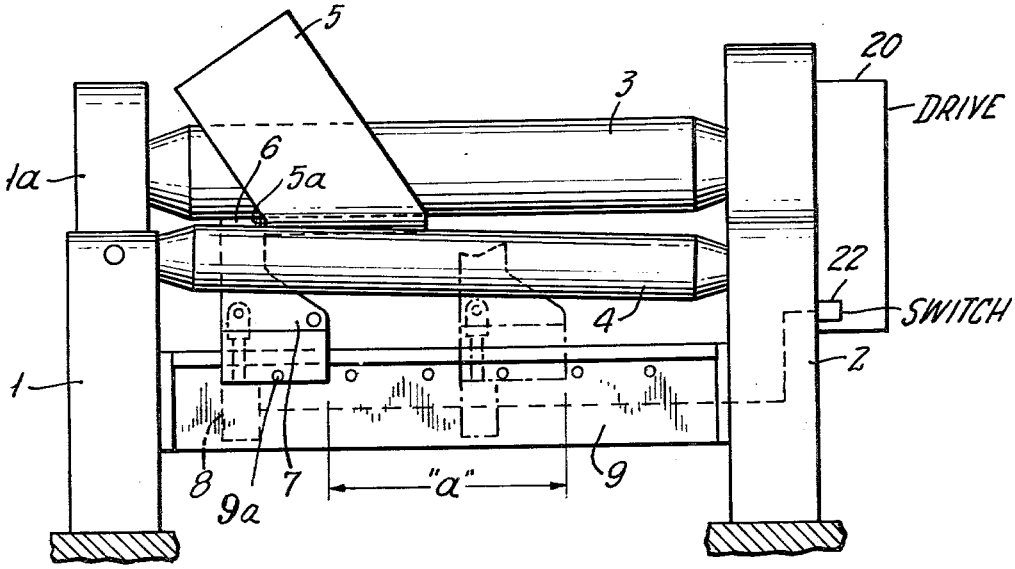
FIG. 1 is a side elevational view showing a plate bending machine having an abutment member which is mounted for displacement in a longitudinal direction on a stationary traverse member.

The abutment members 6 are arranged for movement in the direction of the bearing pressure. FIG. 1 shows the abutment member 6 in the form of an angle lever pivotally mounted at pivot 7 on a stationary traverse member 9. A counter pressure mechanism 8 engages and supports the abutment member in an operating position. If the bearing pressure should become so great as to exceed the adjusted counter pressure provided by the counter pressure mechanism, the counter pressure mechanism will allow the abutment member to yield and the mechanism will engage a contact of a switch 22 to turn off the drive means 20 of the machine. The stroke of the counter pressure mechanism 8 is preferably dimensioned so that lowering of the abutment member from the operating zone is possible.

The abutment member 6 is mounted on the stationary traverse 9 in a manner to permit displacement of the abutment in the longitudinal direction of the bending rolls, for example through a distance "a". Means are also provided for locking the abutment member in the desired longitudinal position along the traverse member. The displacement and locking of the abutment member in a desired position can be accomplished with conventional adjusting means such as spindle, rack, chain drive, locking bolts, etc. Note the locking bolt 9*a* securing the abutment member 6 to the traverse member 9 in FIG. 1.

Figure 2:
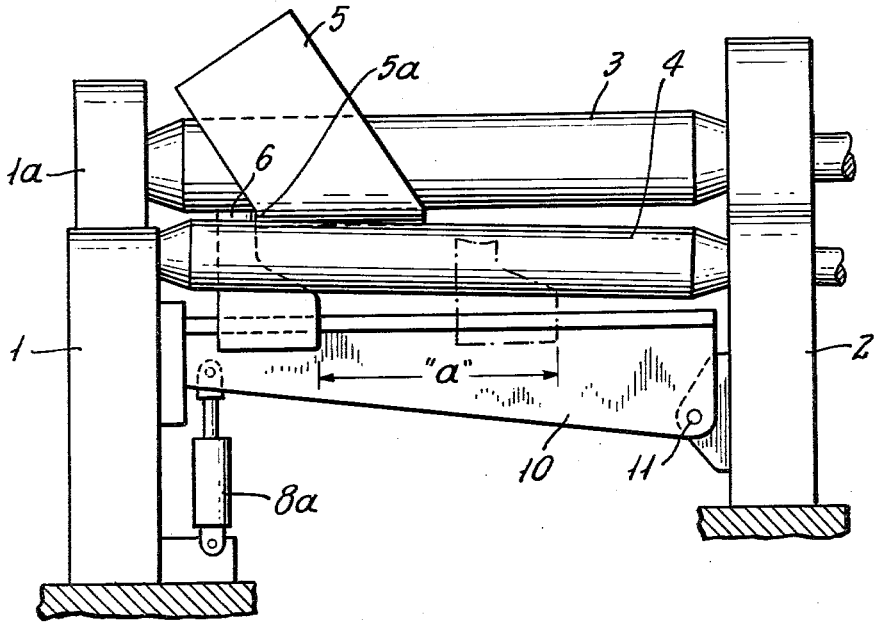
FIG. 2 is a side elevational view similar to that of FIG. 1 showing a plate bending machine having an abutment member which is mounted for longitudinal displacement on a swing lever.

In the embodiment shown in FIG. 2, the abutment member 6 is mounted for longitudinal displacement on a swing lever 10. The swing lever 10 is mounted for articulated movement on roll stand 2 at pivot point 11. The abutment member is held in its operating position by counter pressure mechanism 8*a* engaging the other end of swing lever 10.

Figure 3:
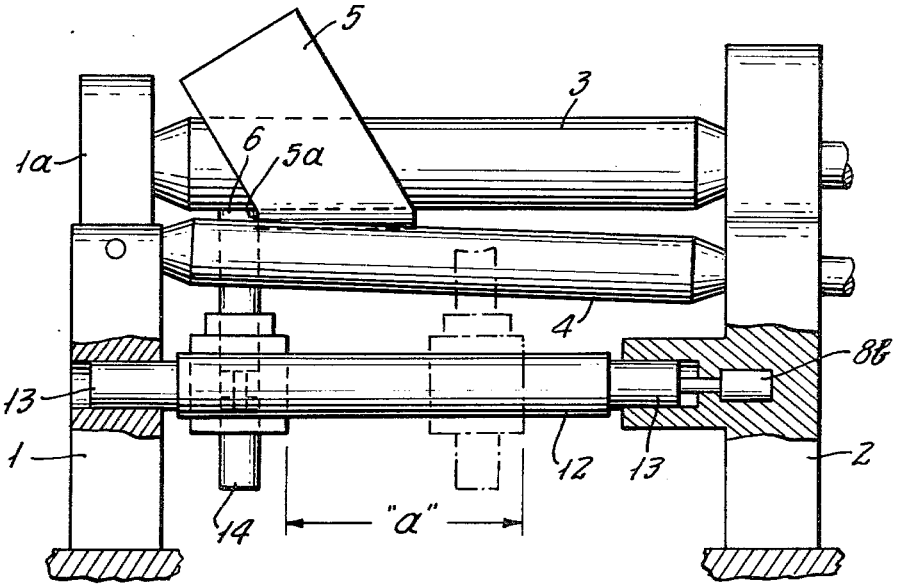
FIG. 3 is a side elevational view similar to that of FIGS. 1 and 2 showing a plate bending machine having an abutment member which is mounted for longitudinal displacement on a movable traverse member which is provided with a counter pressure mechanism and in which the abutment member is retractable.

The embodiment shown in FIG. 3 provides for the abutment member 6 to be mounted for longitudinal displacement on a movable traverse member 12 supported in guides 13, 13 on each of the roll stands 1 and 2. In this embodiment the functions of moving the abutment member out of the working zone or permitting yielding movement as a result of excessive forces are separated. Counter pressure mechanism 8*b* supports movable traverse member 12 and thus abutment member 6 mounted thereon. A separate retracting mechanism 14 permits abutment member 6 to be retracted from the operating zone and to bring it into any desired position within the stroke range of the retracting mechanism.

Figure 4:
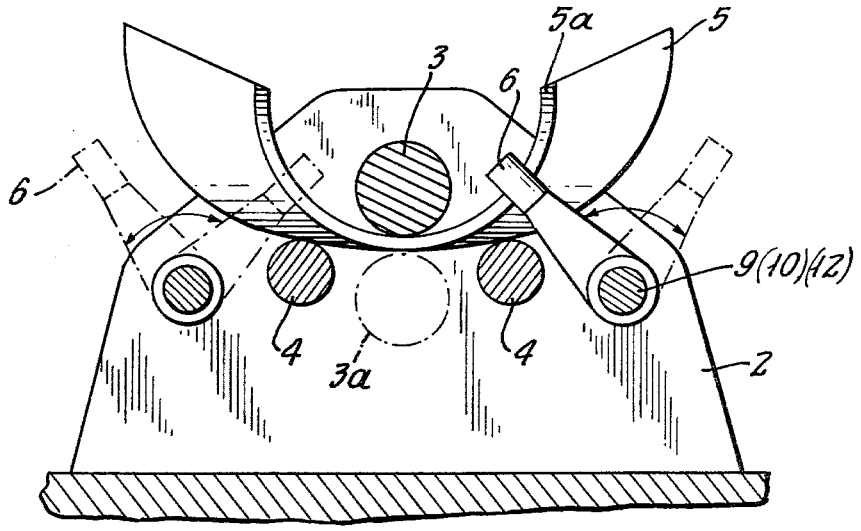
FIG. 4 is a cross sectional view taken through the bending rollers of a bending machine having either a three roller or four roller arrangement and in which the bending machine is provided with two abutments mounted for longitudinal displacement on a movable traverse and for pivotal movement thereabout.
Figure 5:
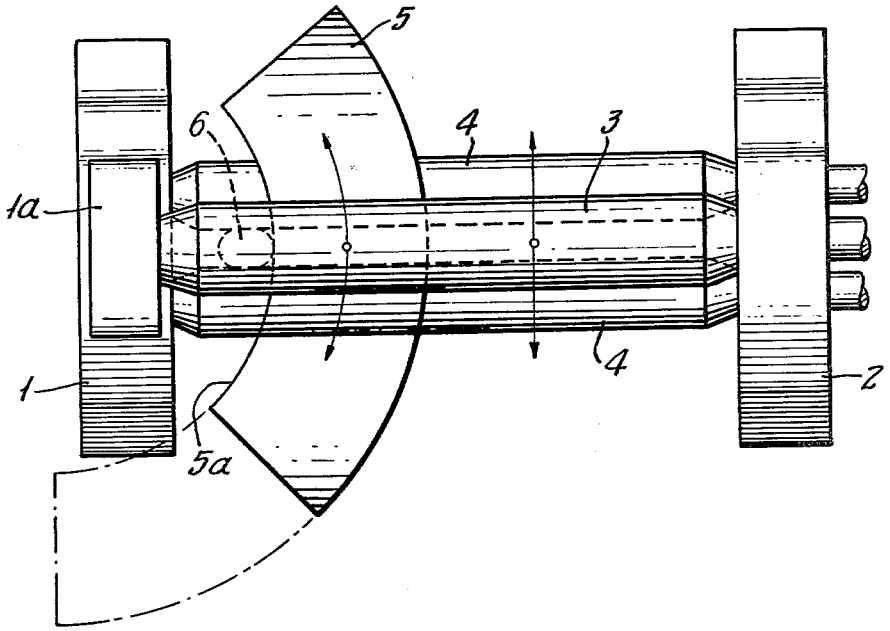
FIG. 5 is a top plan view showing a plate bending machine having a single abutment member.

FIG. 4, which is a vertical section through the bending rollers of either a three or a four roller plate bending machine shows a further embodiment of the present invention in which either one or two abutment members 6 are mounted on either a fixed or a movable traverse member 9,12 or on a swing lever 10 for displacement in a direction parallel to the longitudinal axis of the bending rollers 3, 3*a*, 4. The abutment members 6 are arranged next to the side rollers 4 and are arranged for pivotal movement about the axis of longitudinal displacement so that they may be swung out of the operating zone or may be brought into any desired operating position within the range of permissible pivotal movement.

While the invention has been described and illustrated with respect to certain preferred embodiments which produce satisfactory results, it will be understood by those skilled in the art, after appreciating the purposes of the invention that various other changes and modifications may be made without departing from the spirit and scope of the invention, and it is therefore intended to cover all such changes and modifications in the appended claims.

I claim:

1. A device for bending ring segment-shaped plate blanks having a shorter arc edge along one side and a longer arc edge along the opposite side into conically shaped parts comprising a pair of roll stands, at least one top roller supported between said roll stands, a pair of side rollers supported between said roll stands, means for driving said blanks between said top roller and said side rollers to form the conically shaped parts, at least one abutment member positioned for engaging and guiding the shorter arc edge of the plate blank as it passes between said top roller and said side rollers, and a support assembly including an elastic and adjustable counter pressure mechanism connected to said abutment member for biasing said abutment member against the shorter arc edge of the plate blank with an adjusted counter pressure so that if the pressure exerted by the plate blank exceeds the adjusted counter pressure, said counter pressure mechanism allows said abutment member to yield, and said counter pressure mechanism cooperating with said drive means for controlling said drive means.

2. The device according to claim 1 wherein said counter pressure mechanism is a pressure cylinder.

3. The device according to claim 1 further comprising an additional roller supported between said roll stands cooperating with said top roller to form a central pair of rollers between which the plate blank passes.

4. The device according to claim 1 wherein two said abutment members are spaced apart in the direction of movement of the plate blank between the rollers and are provided for guiding and supporting the shorter arc edge of said plate blank.

5. The device according to claim 1 wherein said abutment member is positioned between said side rollers.

6. The device according to claim 4 wherein said abutment members are positioned on the outside of each of said side rollers.

7. The device according to claim 6 wherein said abutment members are mounted for rotational movement about an axis extending in a direction substantially parallel to the longitudinal axis of said top roller.

8. The device according to claim 6 wherein said abutment members are mounted between said roll stands for displacement in a direction substantially parallel to the axis of said top roller, and means for locking said abutment members in a desired position.

9. The device according to claim 1 wherein said abutment member is mounted for displaceable movement between said roll stands in a direction substantially parallel to the longitudinal axis of said top roller, and means for locking said abutment member in a desired position therebetween.

10. The device according to claim 1 wherein the support assembly comprises a stationary traverse member fixedly mounted between said roll stands, said abutment member being pivotally mounted on said traverse member for rotational movement about an axis extending in a direction perpendicular to the longitudinal axis of said rollers, said counter pressure mechanism engaging said abutment member for limiting the pivotal movement thereof.

11. The device according to claim 1 wherein the support assembly comprises a swing lever pivotally connected at one end thereof to one of said roll stands for pivotal movement about an axis extending in a direction perpendicular to the longitudinal axis of said rollers, said abutment member being carried on said swing lever and positioned between said roll stands, said counter pressure mechanism supporting the other end of said swing lever for limiting the pivotal movement thereof about said axis of rotation in response to bearing pressure applied to said abutment member.

12. The device according to claim 1 wherein the support assembly comprises a movable traverse member mounted between said roll stands for displacement in a direction substantially parallel to the axis of said top roller, said abutment member being carried on said movable traverse member, said abutment member connected to a retracting mechanism mounted on said movable traverse member and acting in a direction perpendicular to the longitudinal axis of said traverse member, said counter pressure mechanism being connected to said movable traverse member for limiting the displacement thereof in response to bearing pressure applied thereto from said abutment member.

13. The device according to claim 3 wherein said counter pressure mechanism is a pressure cylinder.

14. The device according to claim 3 wherein two abutments are provided for guiding and supporting the shorter arc edge of said plate blank.

15. The device according to claim 3 wherein said abutment member is positioned between said side rollers.

16. The device according to claim 14 wherein said abutment members are positioned on the outside of each of said side rollers.

17. The device according to claim 16 wherein said abutments are mounted for rotational movement about an axis extending in a direction substantially parallel to the longitudinal axis of said top roller.

18. The device according to claim 16 wherein said abutment members are mounted between said roll stands for displacement in a direction substantially parallel to the axis of said top roller, and means for locking said abutment members in a desired position.

19. The device according to claim 3 wherein said abutment member is mounted for displaceable movement between said roll stands in a direction substantially parallel to the longitudinal axis of said top roller, and means for locking said abutment member in a desired position therebetween.

20. The device according to claim 3 further comprising a stationary traverse member fixedly mounted between said roll stands, said abutment member being pivotally mounted on said traverse member for rotational movement about an axis extending in a direction perpendicular to the longitudinal axis of said rollers, said counter pressure mechanism engaging said abutment member for limiting the pivotal movement thereof.

21. The device according to claim 3 wherein the support assembly comprises a swing lever pivotally connected at one end thereof to one of said roll stands for pivotal movement about an axis extending in a direction perpendicular to the longitudinal axis of said rollers, said abutment member being carried on said swing lever and positioned between said roll stands, said counter pressure mechanism supporting the other end of said swing lever for limiting the pivotal movement thereof about said axis of rotation in response to bearing pressure applied to said abutment member.

22. The device according to claim 3 wherein the support assembly comprises a movable traverse member mounted between said roll stands for displacement in a direction substantially parallel to the axis of said top roller, said abutment member being carried on said movable traverse member, said abutment member connected to a retracting mechanism mounted on said movable traverse member and acting in a direction perpendicular to the longitudinal axis of said traverse member, said counter pressure mechanism being connected to said movable traverse member for limiting the displacement thereof in response to bearing pressure applied thereto from said abutment member.

* * * * *